US011701598B2

(12) United States Patent
Lee et al.

(10) Patent No.: US 11,701,598 B2
(45) Date of Patent: Jul. 18, 2023

(54) STRUCTURE FOR COUPLING ASSEMBLY BLOCKS

(71) Applicant: CREAMO INC., Seoul (KR)

(72) Inventors: Seok Lee, Seoul (KR); Deok Ha Woo, Seoul (KR); Taik Jin Lee, Seoul (KR); Yong Joon Park, Seongnam-si (KR); Jeong Hun Shin, Daegu (KR)

(73) Assignee: CREAMO INC., Seoul (KR)

( * ) Notice: Subject to any disclaimer, the term of this patent is extended or adjusted under 35 U.S.C. 154(b) by 89 days.

(21) Appl. No.: 17/228,253

(22) Filed: Apr. 12, 2021

(65) Prior Publication Data

US 2021/0268395 A1 Sep. 2, 2021

Related U.S. Application Data

(63) Continuation of application No. PCT/KR2018/011900, filed on Oct. 10, 2018.

(30) Foreign Application Priority Data

Oct. 10, 2018 (KR) ..... 10-2018-0120157

(51) Int. Cl.
*A63H 33/08* (2006.01)

(52) U.S. Cl.
CPC ..... *A63H 33/084* (2013.01); *A63H 33/08* (2013.01); *A63H 33/082* (2013.01)

(58) Field of Classification Search
CPC ..... A63H 33/08; A63H 33/082; A63H 33/084
See application file for complete search history.

(56) References Cited

U.S. PATENT DOCUMENTS 1,130,324 A * 3/1915 Owen ..... A63H 33/082 403/381
2,800,743 A * 7/1957 Meehan ..... A63H 33/084 446/127
2,907,137 A * 10/1959 Rudolf ..... A63H 33/082 52/608

(Continued)

FOREIGN PATENT DOCUMENTS

CN 205549586 U 9/2016
JP 04-030595 U 3/1992

(Continued)

OTHER PUBLICATIONS

International Search Report dated Jul. 9, 2019, corresponding to International Application No. PCT/KR2018/011900 citing the above reference(s).

*Primary Examiner* — John A Ricci
(74) *Attorney, Agent, or Firm* — Hauptman Ham, LLP

(57) ABSTRACT

A structure for coupling assembly blocks of a polyhedral shape formed of a plurality of side plates, a top plate, and a bottom plate, includes a first coupling member formed on a portion of at least one of the plurality of side plates, the top plate, and the bottom plate and a second coupling member formed on a portion of at least one of the plurality of side plates, the top plate, and the bottom plate other than one on which the first coupling member is formed. The first coupling member of one assembly block is configured to couple with the second coupling member of other assembly block in a sliding manner, in a fitting manner, or in a rotating manner.

8 Claims, 15 Drawing Sheets

(56) References Cited

U.S. PATENT DOCUMENTS

| | | | | | |
|---|---|---|---|---|---|
| 2,923,551 | A | * | 2/1960 | Pope | A63H 33/082<br>273/157 R |
| 3,456,413 | A | * | 7/1969 | Fischer | A63H 33/084<br>D25/120 |
| 4,035,947 | A | * | 7/1977 | Burge | A63H 33/082<br>446/127 |
| 4,160,337 | A | * | 7/1979 | Fischer | A63H 33/084<br>446/124 |
| 5,853,314 | A | * | 12/1998 | Bora | A63H 33/086<br>446/124 |
| 2008/0280523 | A1 | | 11/2008 | Bishop | |

FOREIGN PATENT DOCUMENTS

| | | | |
|---|---|---|---|
| JP | 3102975 | U | 7/2004 |
| KR | 10-2010-0037725 | A | 4/2010 |
| KR | 10-1714642 | B1 | 3/2017 |

* cited by examiner

STRUCTURE FOR COUPLING ASSEMBLY BLOCKS

CROSS-REFERENCE TO RELATED APPLICATIONS

This application is a continuation of International Application No. PCT/KR2018/011900, filed Oct. 10, 2018, which is based upon and claims the benefit of priority from Korean Patent Application No. 10-2018-0120157, filed Oct. 10, 2018, the contents of which are incorporated herein by reference in their entirety.

BACKGROUND

1. Field

The present invention relates to a structure for coupling assembly blocks.

2. Description of the Related Art

In general, a toy of an assembly block type includes a hexahedron with a coupling stud on its top and a coupling groove on its bottom, such that assembly blocks can be coupled to each other by fitting the coupling stud of one assembly block into the coupling groove of other assembly block.

However, as the coupling structure employing the coupling stud on the top and the coupling groove on the bottom only offers a coupling of assembly block in the vertical direction, in order to couple assembly blocks in the horizontal direction, a coupling stud and a coupling groove should be formed on sides of the assembly blocks.

In addition, a coupling using the coupling stud and the coupling groove tends to be easily released, and does not offer a coupling of assembly blocks of different sizes.

Korean Patent No. 10-1714642 describes an assembly unit capable of assemble blocks of various polyhedral shapes. Such assembly units can maximize utility and creativity of a user by creating desired unit blocks. However, the conventional stud and groove coupling structure ends up with limiting the degree of freedom of such assembly units.

SUMMARY

According to some embodiments of the present invention, a structure for coupling assembly blocks of a polyhedral shape formed of a plurality of side plates, a top plate, and a bottom plate, includes a first coupling member formed on a portion of a first outer surface of at least one of the plurality of side plates, the top plate, and the bottom plate and a second coupling member formed on a portion of a second outer surface of at least one of the plurality of side plates, the top plate, and the bottom plate other than one on which the first coupling member is formed. The first coupling member of one assembly block is configured to couple with the second coupling member of other assembly block in a sliding manner, in a fitting manner, or in a rotating manner.

According to some embodiments of the present invention, an assembly block includes a polyhedron formed of a plurality of side plates, a top plate, and a bottom plate and the structure according to some embodiments of the present invention on at least one of the plurality of side plates, a top plate, and a bottom plate.

According to some embodiments of the present invention, an assembly toy includes the assembly block according to some embodiments of the present invention.

According to some embodiments of the present invention, an assembly unit configured to form an assembly block of a polyhedral shape by assembling a plurality of unit plates, includes the structure according to some embodiments of the present invention on at least one of the plurality of unit plates.

According to some embodiments of the present invention, a smart toy includes the assembly unit according to some embodiments of the present invention.

The above and other objects, features, advantages and technical and industrial significance of this invention will be better understood by reading the following detailed description of presently preferred embodiments of the invention, when considered in coupling with the accompanying drawings.

DETAILED DESCRIPTION OF THE SOME EMBODIMENTS

Exemplary embodiments of the present invention are described in detail below with reference to the accompanying drawings.

Figure 1A:
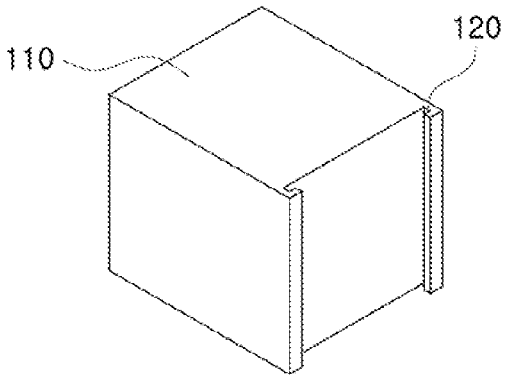
FIGS. 1A to 1C are perspective views of a structure for coupling assembly blocks according to at least one embodiment of the present invention.
Figure 1B:
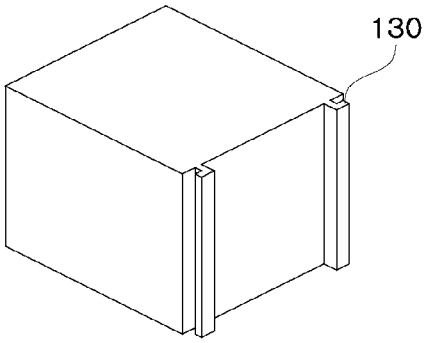
Figure 1C:
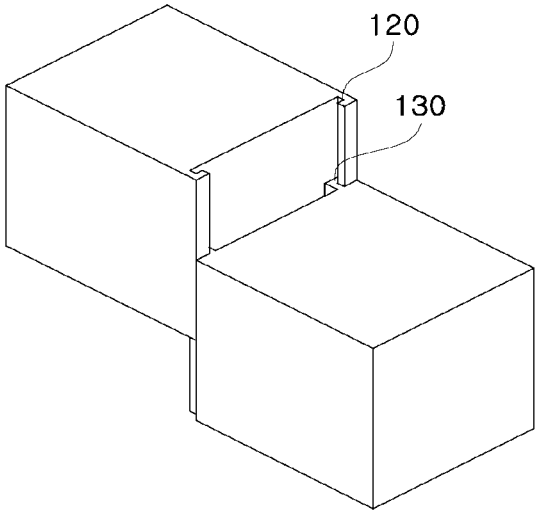

FIGS. 1A to 1C are perspective views of a structure for coupling assembly blocks according to at least one embodiment of the present invention.

As shown in FIGS. 1A to 1C, the structure for coupling assembly blocks according to at least one embodiment of the present invention is a structure for coupling a polyhedral assembly block 110 formed of a plurality of plates to another assembly block 110.

The structure for coupling assembly blocks according to at least one embodiment of the present invention shown in FIGS. 1A to 1C includes a first coupling member 120 formed on at least a portion of a first outer surface of at least one of a plurality of side plates, a top plate, and a bottom plate of the assembly block 110 and a second coupling member 130 formed on at least a portion of a second outer surface of at least one of the plurality of side plates, the top plate, and the bottom plate other than one on which the first coupling member 120 is formed.

FIGS. 1A to 1C show a hexahedral assembly block including four side plates, a top plate, and a bottom plate. However, the present invention can be applied to a polyhedral structure including a cylindrical type having a rounded side plate, a pyramid type having four triangular plates, or multilateral column type having five or more side plates.

As shown in FIG. 1C, the first coupling member 120 of one assembly block is coupled to the second coupling member 130 of another assembly block in a sliding manner.

Although a coupling mode in which the first coupling member 120 of one assembly block is coupled to the second coupling member 130 of other one assembly block in a sliding manner is shown in FIG. 10, the structure for coupling assembly blocks according to some embodiments of the present invention is also capable of coupling assembly blocks in a fitting manner or a rotating manner.

As shown in FIGS. 1A to 10, the first coupling member 120 includes grooves formed along both edges of the first outer surface of a plate, and the second coupling member 130 includes protrusions formed along both edges of the second outer surface of a plate. The protrusions are configured to slide into the respective grooves when coupling one assembly block to other assembly block.

In some embodiments of the present invention, the grooves of the first coupling member 120 are formed along the respective edges from one end to other end of the first outer surface, and each of the protrusions of the second coupling member 130 is formed on at least a portion of each of the edges of the second outer surface.

In some embodiments of the present invention, each of the grooves of the first coupling member 120 is formed on at least a portion of each of the edges of the first outer surface, and the protrusions of the second coupling member 130 are formed along the respective edges from one end to other end of the second outer surface.

As shown in FIG. 10, by coupling the first coupling member 120 of one assembly block to the second coupling member 130 of another assembly block in a sliding manner, the assembly blocks can be coupled to each other in a various shape with ease, and the assembled blocks can maintain the assembled state even when an impact is applied to the assembled blocks.

Figure 2A:
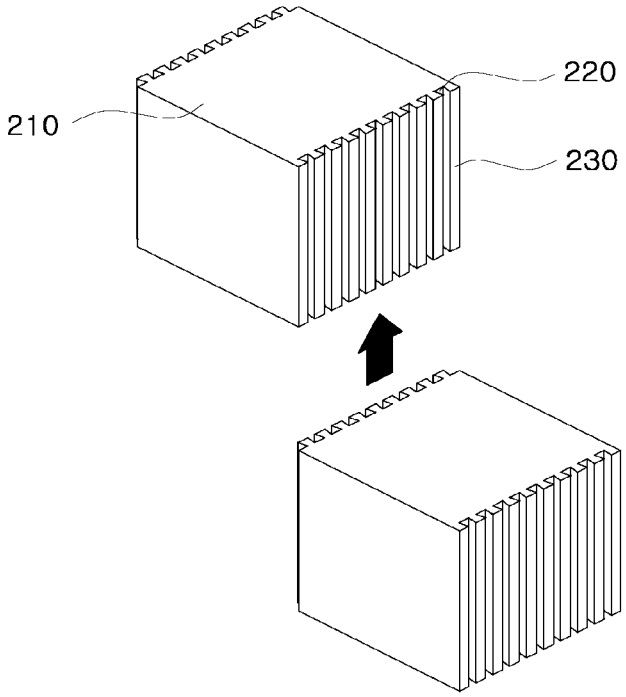
FIGS. 2A and 2B are perspective views of a structure for coupling assembly blocks according to at least one embodiment of the present invention.
Figure 2B:
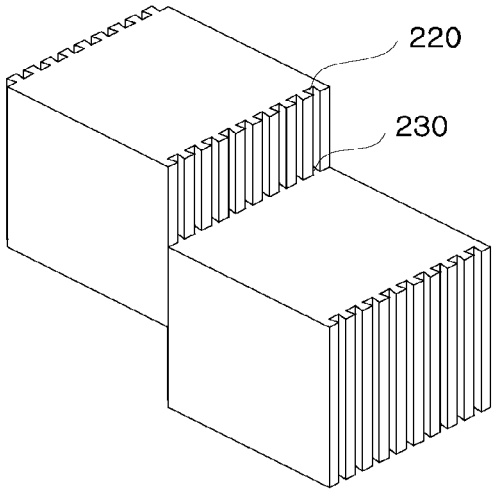

FIGS. 2A and 2B are perspective views of a structure for coupling assembly blocks according to at least one embodiment of the present invention.

As shown in FIG. 2A, a first coupling member 220 of a polyhedral assembly block 210 includes at least two first protrusions formed on at least a portion of the first outer surface and a groove between the two first protrusions, and a second coupling member 230 includes a second protrusion formed on at least a portion of the second outer surface. The second protrusion is configured to slide into the groove when coupling one assembly block to other assembly block.

In some embodiments of the present invention, the first protrusions and the groove of the first coupling member 220 and the second protrusion of the second coupling member 230 are formed in parallel to at least one side of the first and second outer surfaces of the plate.

Although an example in which the first protrusions and the groove of the first coupling member 220 and the second protrusion of the second coupling member 230 are formed in parallel to at least one side of the first and second outer surfaces of the plate is shown in FIGS. 2A and 2B, in some embodiments of the present invention, the first protrusions and the groove of the first coupling member 220 and the second protrusion of the second coupling member 230 are formed at a predetermined angle with respect to at least one side of the first and second outer surfaces.

Although an example in which the first protrusions and the groove of the first coupling member 220 and the second protrusion of the second coupling member 230 are formed in parallel to at least one side of the first and second outer surfaces of the plate across a whole surface is shown in FIGS. 2A and 2B, in some embodiments of the present invention, the first protrusions and the groove of the first coupling member 220 and the second protrusion of the second coupling member 230 are formed in parallel to at least one side of the first and second outer surfaces of the plate on a portion of a whole surface.

As shown in FIG. 2B, by coupling the first coupling member 220 of one assembly block 210 with the second coupling member 230 of another assembly block 210 in a sliding manner, the assembly blocks can be coupled to each other in a various shape with ease, and the assembled blocks can maintain the assembled state even when an impact is applied to the assembled blocks.

Figure 3A:
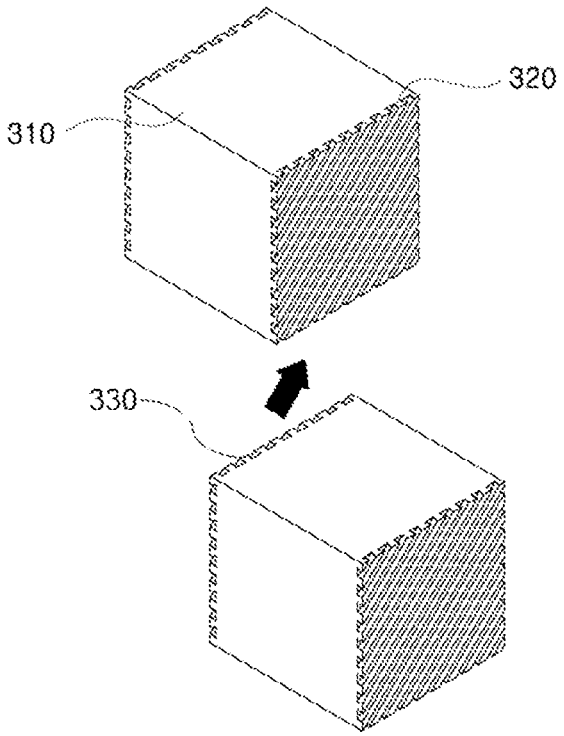
FIGS. 3A and 3B are perspective views of a structure for coupling assembly blocks according to at least one embodiment of the present invention.
Figure 3B:
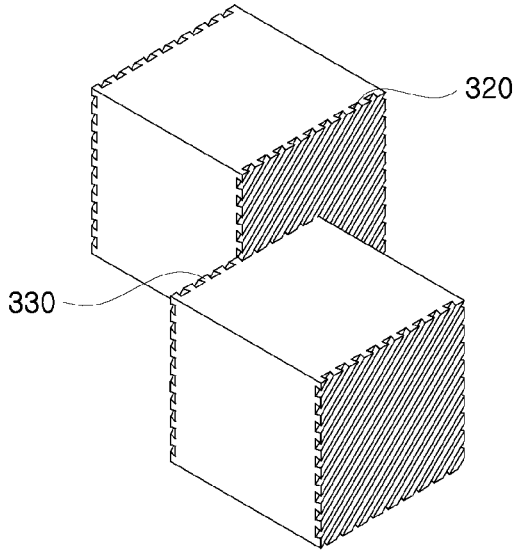

FIGS. 3A and 3B are perspective views of a structure for coupling assembly blocks according to at least one embodiment of the present invention.

As shown in FIGS. 3A and 3B, a first coupling member 320 of a polyhedral assembly block 310 includes at least two first protrusions formed on at least a portion of the first outer surface and a groove between the two first protrusions, and a second coupling member 330 includes a second protrusion formed on at least a portion of the second outer surface. The second protrusion is configured to slide into the groove when coupling one assembly block to other assembly block.

In the example shown in FIGS. 3A and 3B, the first protrusions and the groove of the first coupling member 320 and the second protrusion of the second coupling member 330 are formed to make a predetermined angle with respect to at least one side of the plate.

As shown in FIG. 3B, by coupling the first coupling member 320 of one assembly block 310 with the second coupling member 330 of another assembly block 310 in a sliding manner at the predetermined angle, the assembly blocks can be coupled to each other in a various shape with ease, and the assembled blocks can maintain the assembled state even when an impact is applied to the assembled blocks.

Figure 4A:
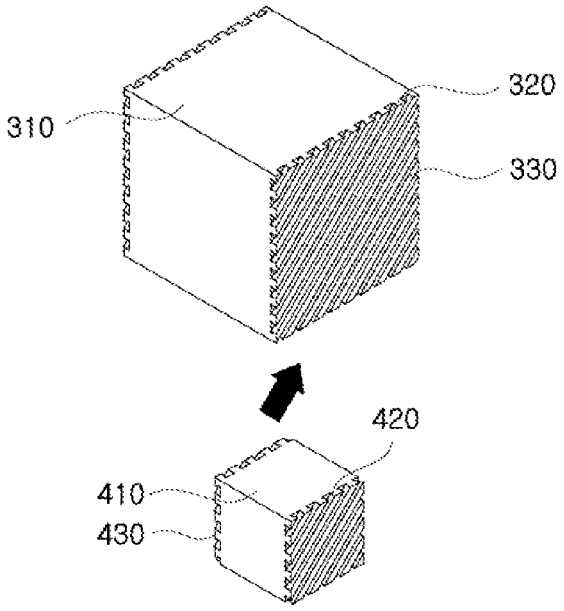
FIGS. 4A and 4B are perspective views of a structure for coupling assembly blocks according to at least one embodiment of the present invention.
Figure 4B:
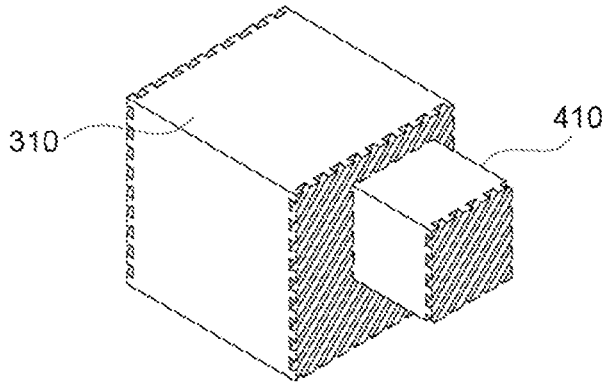

FIGS. 4A and 4B are perspective views of a structure for coupling assembly blocks according to at least one embodiment of the present invention.

The structure for coupling assembly blocks shown in FIGS. 4A and 4B is basically similar to the structure for coupling assembly blocks shown in FIGS. 3A and 3B. As shown in FIGS. 4A and 4B, the structure for coupling assembly blocks according to some embodiments of the present invention includes a first coupling member 420 and a second coupling member 430, which are smaller than the first coupling member 320 and the second coupling member 330, respectively.

With a conventional structure for coupling assembly blocks, it is hard to couple two assembly blocks of different sizes; however, as shown in FIG. 4B, the structure for coupling assembly blocks according to some embodiments of the present invention offers an easy coupling of one assembly block 310 with other assembly block 410 with different sizes from each other in various manner.

Figure 5:
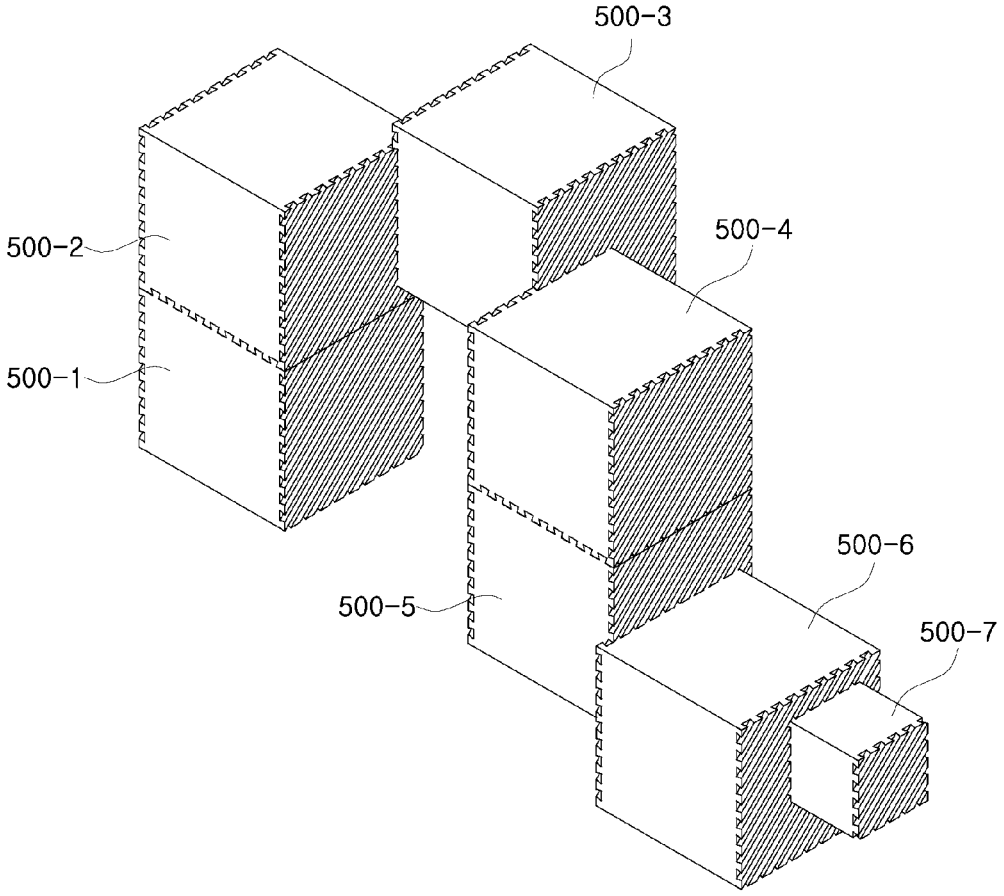
FIG. 5 is a perspective view of various couplings of assembly blocks using the structure for coupling assembly blocks according to at least one embodiment of the present invention.

FIG. 5 is a perspective view of various couplings of assembly blocks using the structure for coupling assembly blocks according to at least one embodiment of the present invention.

As shown in FIG. 5, with the structure for coupling assembly blocks according to at least one embodiment of the present invention and assembly blocks 500-1 to 500-7 on which the structure for coupling assembly blocks according to at least one embodiment of the present invention is applied, polyhedral assembly blocks of various sizes can be coupled with each other in different directions.

FIGS. 6A to 6D are cross-sectional views of a structure for coupling assembly blocks according to at least one embodiment of the present invention, in which the assembly blocks are coupled in a sliding manner.

Figure 6A:
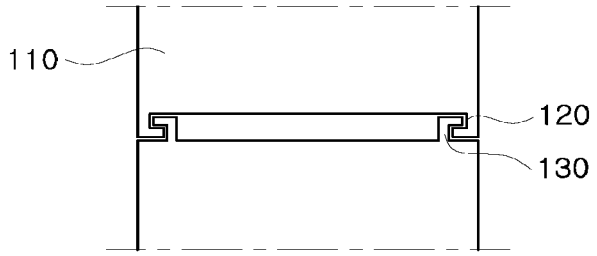
FIGS. 6A to 6D are cross-sectional views of a structure for coupling assembly blocks according to at least one embodiment of the present invention, in which the assembly blocks are coupled in a sliding manner.

The structure shown in FIG. 6A is a rail-type coupling structure applied to the assembly block 110 shown in FIG. 1, which shows a mode of coupling the first coupling member 120 with the second coupling member 130.

Figure 6B:
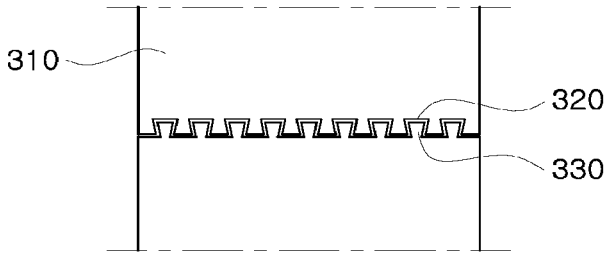
Figure 6C:
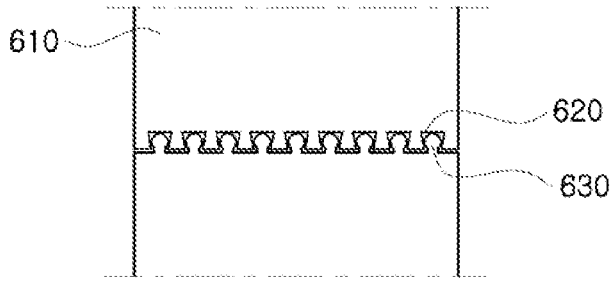
Figure 6D:
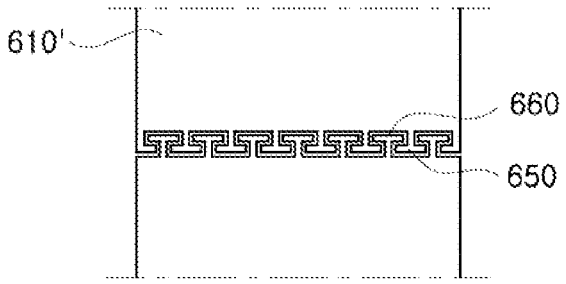

FIGS. 6B, 6C, and 6D show the coupling structure of the protrusions and the grooves applied to the structures shown in FIGS. 2 to 5.

In an example shown in FIG. 6B, each of the first protrusions of the first coupling member 320 is formed with a cross section in a tapered shape expanding outwards, the groove is formed with a cross section in a tapered shape expanding inwards accordingly, and the second protrusion of the second coupling member 330 is formed with a cross section in a tapered shape expanding outwards, such that the second protrusion is fitted into the groove in a sliding manner when coupling one assembly block to other assembly block.

In an example shown in FIG. 6C, each of the first protrusions of the first coupling member 620 is formed with a cross section in a tapered shape expanding outwards, the groove is formed with a cross section in a tapered shape expanding inwards accordingly, and the second protrusion of the second coupling member 630 is formed in a substantially spherical shape, such that the second protrusion is fitted into the groove in a sliding manner when coupling one assembly block to other assembly block.

The phrase 'substantially spherical shape' means to include a spherical shape and a balloon shape.

In an example shown in FIG. 6D, a first coupling member 650 of a polyhedral assembly block 610' include at least two T-shaped rails formed on at least a portion of the first outer surface, and a second coupling member 660 includes at least one T-shaped rail formed on at least a portion of the second outer surface.

The T-shaped rail of the second coupling member 660 is fitted between the T-shaped rails of the first coupling member 650 in a sliding manner when coupling one assembly block to other assembly block.

Figure 7A:
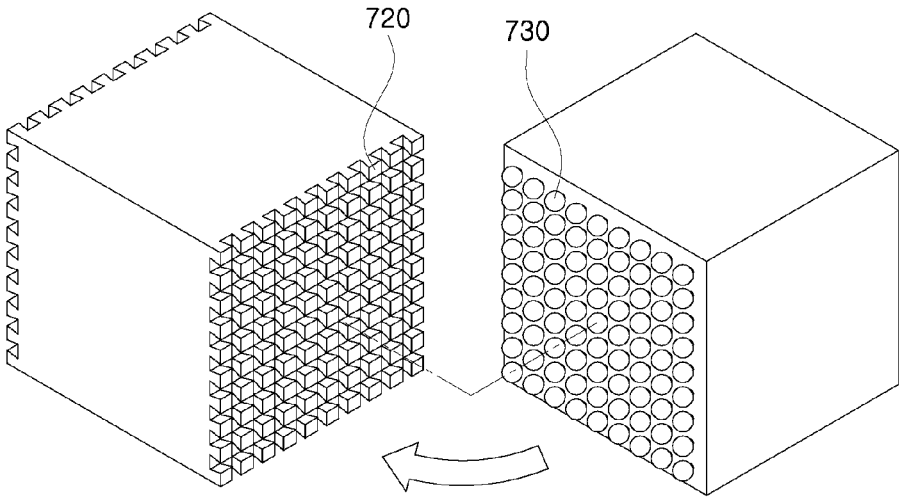
FIGS. 7A to 7C are perspective views of a structure for coupling assembly blocks according to at least one embodiment of the present invention.
Figure 7B:
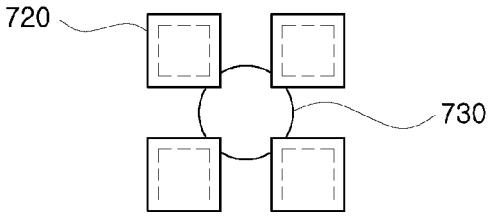
Figure 7C:
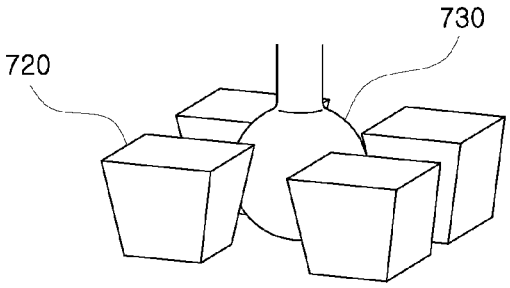

FIGS. 7A to 7C are perspective views of a structure for coupling assembly blocks according to at least one embodiment of the present invention.

As shown in FIGS. 7A to 7C, the structure for coupling assembly blocks according to at least one embodiment of the present invention includes a first coupling member 720 formed on at least a portion of the first outer surface of at least one of the plurality of plates of a polyhedral assembly block and a second coupling member 730 formed on at least a portion of the second outer surface of at least one of the plurality of plates.

The first coupling member 720 member include at least two first protrusions formed on at least a portion of the first outer surface and a space between the first protrusions, and the second coupling member 730 includes a second protrusion of a substantially spherical shape formed on at least a portion of the second outer surface. The second protrusion is fitted into the space when coupling one assembly block to other assembly block.

The phrase 'substantially spherical shape' means to include a spherical shape and a balloon shape.

As the structure for coupling assembly blocks shown in FIGS. 7A to 7C can couple assembly blocks in a sliding manner and in a fitting manner, various coupling modes can be achieved.

Although an example in which the first protrusions and the space therebetween of the first coupling member 720 and the second protrusion of the second coupling member 730 are formed across a whole surface of a plate is shown in FIG. 7A, the first protrusions and the space therebetween of the first coupling member 720 and the second protrusion of the second coupling member 730 can be formed on a portion of a whole surface of a plate.

By coupling the second protrusion of the second coupling member 730 with the space of the first coupling member 720 in a sliding manner or in a fitting manner, the assembly blocks can be coupled to each other in a various shape with ease, and the assembled blocks can maintain the assembled state even when an impact is applied to the assembled blocks.

Figure 8A:
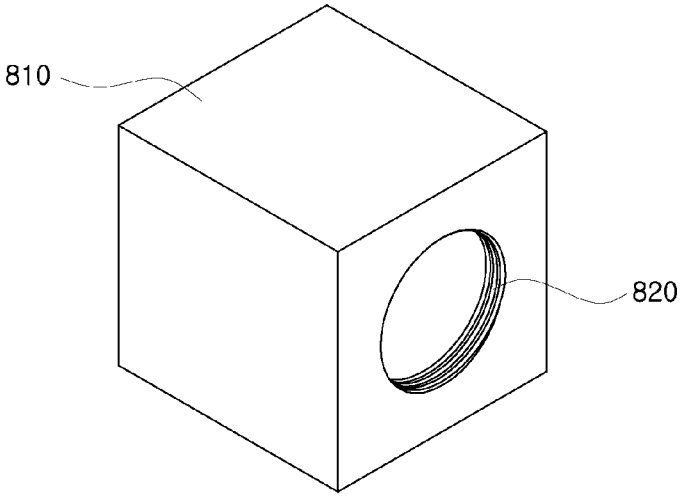
FIGS. 8A and 8B are perspective views of a structure for coupling assembly blocks according to at least one embodiment of the present invention.
Figure 8B:
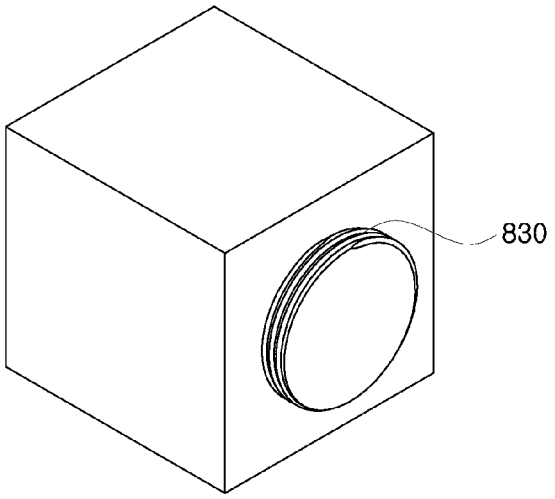

FIGS. 8A and 8B are perspective views of a structure for coupling assembly blocks according to at least one embodiment of the present invention.

As shown in FIGS. 8A and 8B, the structure for coupling assembly blocks according to at least one embodiment of the present invention includes a first coupling member 820 formed on at least a portion of the first outer surface of at least one of the plurality of plates of a polyhedral assembly block and a second coupling member 780 formed on at least a portion of the second outer surface of at least one of the plurality of plates.

The first coupling member 820 include a first thread formed on at least a portion of the first outer surface, the second coupling member 830 includes a second thread formed on at least a portion of the second outer surface, such that the first thread and the second thread are coupled in a rotating manner when coupling one assembly block to other assembly block.

By coupling the first thread of the first coupling member 820 with the second thread of the second coupling member 830 in a screwing (rotating) manner, the assembly blocks can be coupled to each other in a various shape with ease, and the assembled blocks can maintain the assembled state even when an impact is applied to the assembled blocks.

Forming the structure for coupling assembly blocks described above on an outer surface of at least one of the plates constituting a polyhedral assembly block, the assembly blocks can be coupled to each other in a various shape with ease, and the assembled blocks can maintain the assembled state even when an impact is applied to the assembled blocks.

In addition, with such assembly blocks, the assembly blocks can be coupled to each other in a various shape with ease, and it is possible to provide an assembly toy including the assembled blocks maintaining the assembled state even when an impact is applied to the assembled blocks.

Figure 9:
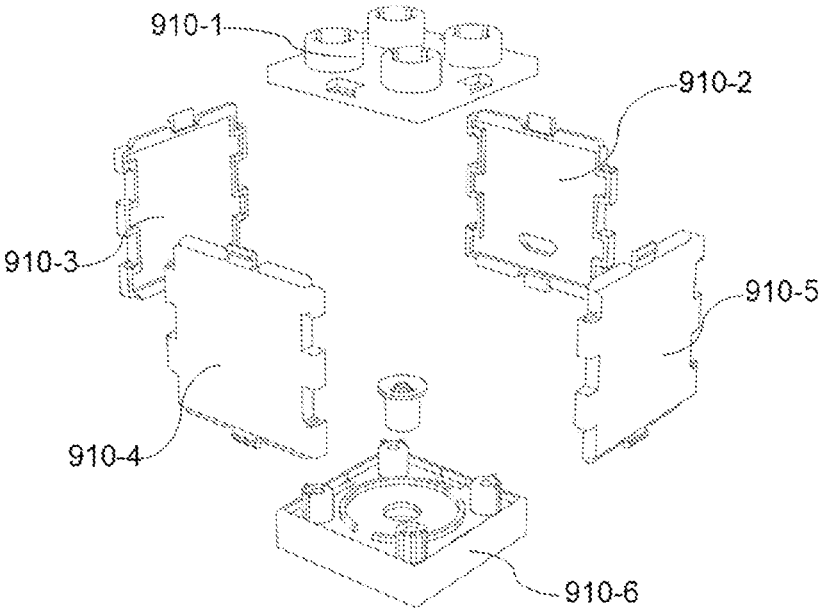
FIG. 9 is an exploded perspective view of an assembly unit according to at least one embodiment of the present invention.

FIG. 9 is an exploded perspective view of an assembly unit according to at least one embodiment of the present invention.

The assembly unit according to some embodiments of the present invention is configured to form a polyhedral assembly block by coupling a plurality of unit plates with each other, including a top plate 910-1, a bottom plate 910-6, and a plurality of side plates 910-2 to 910-5. A body formed by the top plate 910-1, the bottom plate 910-6, and the side plates 910-2 to 910-5 is a mere example, and in some embodiments, the body can have a spherical shape, an elliptical shape, or a polyhedral shape.

For the sake of explanation, as shown in FIG. 9, the assembly unit according to some embodiments of the present invention includes the top plate 910-1, the bottom plate 910-6, and the side plates 910-2 to 910-5, forming a hexahedral body.

Each of the top plate 910-1, the bottom plate 910-6, and the side plates 910-2 to 910-5 forming the body includes grooves and protrusions, such that the plates can be coupled with each other in a removable manner by coupling the grooves and the protrusions.

The body forms a case of a smart block for a smart toy platform. The body can support a base unit (not shown), an application unit (not shown), a function unit (not shown), and a power unit (not shown). The body can have a shape having inside and outside. The base unit, the application unit, and the power unit can be disposed inside the body. The function unit can be disposed inside the body, on an outer surface of the body, across a plate, or integrally with a plate.

The base unit is configured to provide a basic function of the smart toy platform. Such a basic function includes an application support function for the application unit. The application support function can include at least one of a power supply function and a communication function. The power supply function is a function for supplying power to the application unit. The communication function includes a wired or wireless communication function with which the application unit communicates with an external device. The wired communication function can support a serial communication including any one of UART(RS232-C), USB (Universal Serial Bus), SATA, and IEEE 1294. The wireless communication can support any one of WiFi, Zig-bee, 3G, 4G, LTE, and RF communication.

The application unit and the function unit can provide specific functions to the smart toy platform. For example, when the function unit includes a camera module having a function of recording a photo or a movie, the application unit can control the camera module and process the photo or the movie recorded using the camera module, such that the smart toy platform makes a toy having a recording function.

In some embodiments of the present invention, the function unit includes a module for performing a specific function. The function unit includes at least one of a camera module, a sound module, a lighting module, a sensor module, a motor module, an image display module, and an input module; the sound module includes a speaker, the lighting module includes a light emitting device, the sensor module includes any one of a touch sensor, a temperature sensor, a humidity sensor, a photo sensor, and a touch pad, the image display module includes any one of an LCD module, an LED module, an electronic ink module, and a CRT module, and the input module includes any one of a keypad module, a switch module, and a microphone module.

By disposing a function unit on a plate or by coupling a plate with a function disposed thereon to a body, the smart toy platform can make a toy having a function provided by the function unit.

The power unit is configured to supply power to any one of the base unit, the application unit, and the function unit. The power unit can include a battery. The battery can be disposable or rechargeable.

By substituting a first plate on which a first function unit is disposed with a second plate on which a second function unit is disposed, the smart toy platform can provide a smart toy having a new function. In addition, by employing both the first plate and the second plate, the smart toy platform can provide a smart toy having both the first function and the second function.

In some embodiments of the present invention, the assembly unit can include the structure for coupling assembly blocks shown in FIGS. 1 to 8B on the outer surface of at least one unit plate among the plurality of unit plates.

In addition, in some embodiments of the present invention, the smart toy can include the assembly unit described above.

As described above, according to some embodiments of the present invention, it is possible to provide a structure for coupling assembly blocks in an arbitrary direction.

Further, according to some embodiments of the present invention, it is possible to provide a structure for coupling assembly blocks of arbitrary sizes.

Moreover, according to some embodiments of the present invention, it is possible to provide a assembly block, an assembly unit, an assembly toy, and a smart toy including a structure for coupling assembly blocks of arbitrary sizes in an arbitrary direction.

The present disclosure should not be limited to these embodiments but various changes and modifications are made by one ordinarily skilled in the art within the subject matter, the spirit and scope of the present disclosure as hereinafter claimed. Specific terms used in this disclosure and drawings are used for illustrative purposes and not to be considered as limitations of the present disclosure. Exemplary embodiments of the present disclosure have been described for the sake of brevity and clarity. Accordingly, one of ordinary skill would understand the scope of the claimed invention is not to be limited by the explicitly described above embodiments but by the claims and equivalents thereof.

What is claimed is:

1. A structure for coupling assembly blocks of a polyhedral shape formed of a plurality of side plates, a top plate, and a bottom plate, the structure comprising:

a first coupling member formed on a portion of a first outer surface of at least one of the plurality of side plates, the top plate, and the bottom plate; and a second coupling member formed on a portion of a second outer surface of at least one of the plurality of side plates, the top plate, and the bottom plate other than one on which the first coupling member is formed, wherein the first coupling member of one assembly block is configured to couple with the second coupling member of other assembly block in a sliding manner, in a fitting manner, or in a rotating manner, the first coupling member includes at least two first protrusions formed on at least a portion of the first outer surface and a groove between the two first protrusions, the second coupling member includes a second protrusion formed on at least a portion of the second outer surface, the second protrusion is configured to slide into the groove when coupling one assembly block to other assembly block, each of the first protrusions is formed with a cross section in a tapered shape expanding outwards, the groove is formed with a cross section in a tapered shape expanding inwards, the second protrusion is formed in a substantially spherical shape, and the second protrusion is fitted into the groove when coupling one assembly block to other assembly block.

2. The structure according to claim 1, wherein the first protrusions and the groove are formed in parallel to at least one side of the first outer surface, and the second protrusion is formed in parallel to at least one side of the second outer surface.

3. The structure according to claim 1, wherein the first protrusions and the groove are formed at a predetermined angle with respect to at least one side of the first outer surface, and the second protrusion is formed at the predetermined angle with respect to at least one side of the second outer surface.

4. The structure according to claim 1, wherein each of the first protrusions is formed with a cross section in a tapered shape expanding outwards, the groove is formed with a cross section in a tapered shape expanding inwards, the second protrusion is formed with a cross section in a tapered shape expanding outwards, and the second protrusion is fitted into the groove in a sliding manner when coupling one assembly block to other assembly block.

5. An assembly block, comprising:

a polyhedron formed of a plurality of side plates, a top plate, and a bottom plate; and the structure according to claim 1 on at least one of the plurality of side plates, a top plate, and a bottom plate.

6. An assembly toy, comprising the assembly block according to claim 5.

7. An assembly unit configured to form an assembly block of a polyhedral shape by assembling a plurality of unit plates, the assembly unit comprising:

the structure according to claim 1 on at least one of the plurality of unit plates.

8. A smart toy, comprising the assembly unit according to claim 7.

* * * * *